United States Patent [19]

Brookes et al.

[11] 4,102,168

[45] Jul. 25, 1978

[54] ROTARY EXPANSION TOOL

[75] Inventors: Frederick D. Brookes, Northwood; Jozef T. Franek, Chorleywood, both of England

[73] Assignee: Metal Box Limited, Reading, England

[21] Appl. No.: 784,461

[22] Filed: Apr. 4, 1977

[30] Foreign Application Priority Data

Apr. 22, 1976 [GB] United Kingdom ..... 16254/76

[51] Int. Cl.[2] ..... B21D 41/02

[52] U.S. Cl. ..... 72/117; 72/122; 72/126

[58] Field of Search ..... 113/120 M, 120 AA; 72/118, 120, 122, 123, 117, 124, 125, 126

[56] References Cited

U.S. PATENT DOCUMENTS 786,064 3/1905 Smith ..... 72/126

3,266,451 8/1966 Kraus ..... 113/120 AA

*Primary Examiner*—Lowell A. Larson

*Attorney, Agent, or Firm*—Charles E. Brown

[57] ABSTRACT

Apparatus for expanding the mouth of a hollow article, said apparatus comprising a rotary expansion tool and a holding pad reciprocable towards and away from the tool. The rotary expansion tool includes a cage, a plurality of rolls held in equispaced relationship by the cage around an inner race which holds the rolls in rolling engagement with the outer race. Means within the tool cause the rolls to roll within the outer race, each of said rolls having a work portion, extending in an axial direction from the outer race. The work portions enter the mouth of an article pushed into engagement therewith by the pad, to expand the mouth an axial distance determined by the length of a mandrel which serves to guide the article to the rolls. A sleeve shrouds the working surface of the rolls for safety.

14 Claims, 4 Drawing Figures

ROTARY EXPANSION TOOL

This invention relates to apparatus for shaping the mouth of a hollow article, and more particularly but not exclusively to apparatus for expanding the mouth of a can before trimming to form a rim thereon.

In our copending British Patent Application number 17802/74 a method of trimming a metal container to form a rim is described which comprises the steps of presenting the container body to expansion means for expanding a peripheral marginal portion of the body; expanding the marginal portion thereby; supporting the expanded marginal portion on a supporting means; and moving, axially relative to the supporting means, cutting means substantially coaxial with the supporting means, so as to coact with the support means whereby to sever the expanded marginal portion and so form said rim.

This invention provides a rotary expansion tool for radially expanding the mouth of a hollow article, said tool comprising a cage, a plurality of rollers held by the cage and circumferentially spaced in an orbit defining a longitudinal axis, an inner race and an outer race, coaxial with the orbit, the inner race holding the rollers between itself and the outer race, each said roller having a work portion projecting longitudinally beyond the outer race, and the tool having means for precessing the rollers, within the outer race, in said orbit around said axis, whereby said work portions can engage within the mouth of a said article held coaxially with said orbit, so as to expand said mouth. The rolls may be urged to roll within the outer race by driving the cage or alternatively by driving the inner race. In a preferred embodiment a sleeve surrounds said portion of the rollers to limit the outward expansion of the article. A mandrel coaxial with the sleeve and of predetermined length may be provided to guide the article to the rotary expanding tool and limit the axial extent of the expanded portion.

Various embodiments of the apparatus will now be described by way of example and with reference to the accompanying drawings in which.

Figure 1:
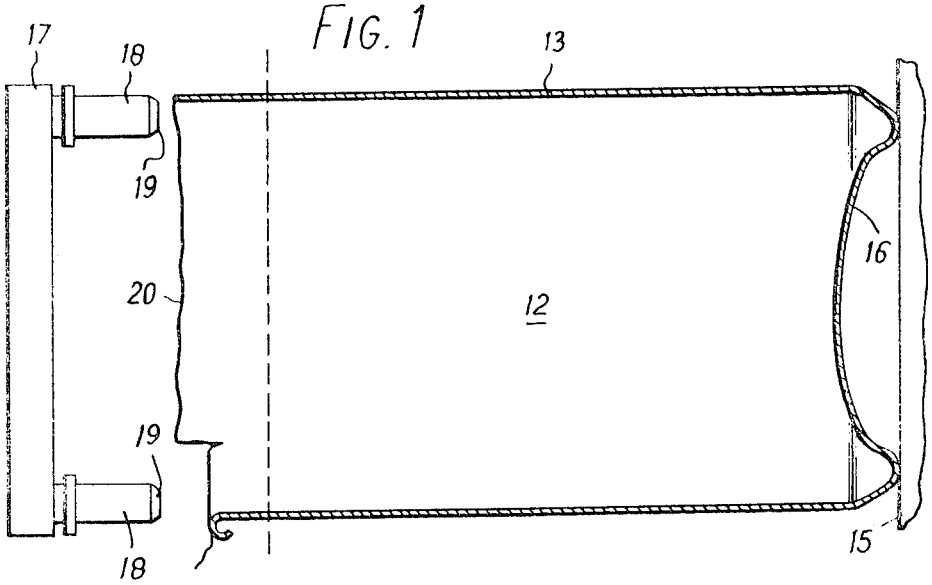
FIG. 1 is a sectioned side elevation of rotary expanding apparatus as described in our copending Patent Application 17802/74, for expanding a peripheral margin adjacent to the mouth of a drawn can.

In FIG. 1 the apparatus comprises a rotatable expansion tool 17 bearing a plurality of freely rotatable expander rolls 18 and an axially reciprocable pusher plate 15. A can 12 having a mouth 20 defined by a cylindrical side wall 13, which extends to a bottom 16 integral therewith, is engaged with the pusher plate 15, In FIG. 1 the pusher plate 15 is about to push the can 12 towards the expander rolls 18, which are travelling in a circular path, on the tool 17. As the rolls 18 enter the mouth 20 of the can 12 a peripheral marginal portion, adjacent to the mouth 20 of the can 12, is expanded to an internal diameter substantially equal to the envelope diameter of the outside of the expander rolls 18. Each roll 18 is provided with a tapered portion 19 to assist its entry into the can as the expansion tool 17 rotates.

Figure 2:
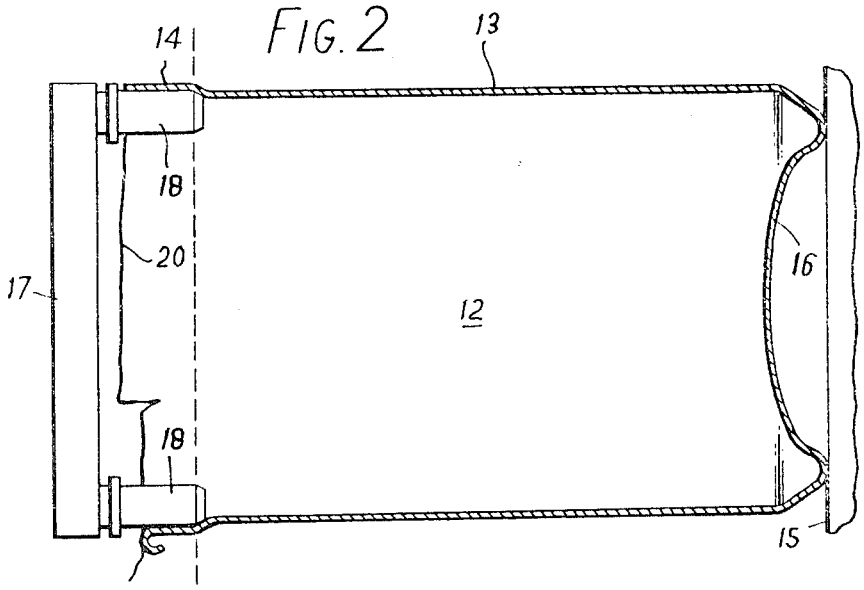
FIG. 2 is a similar view to FIG. 1 showing the can after the expansion of the peripheral portion.

In FIG. 2 the expanded peripheral portion is denoted 14 and axial extent of the expanded portion 14 is governed by the distance through which the can is pushed by the pusher 15, towards the expansion tool 17. The desired distance from the can bottom 16, at which the expanded portion joins the can wall 13 is depicted by a dashed line.

In the prior art embodiments shown in FIGS. 1 and 2 each roll 18 rotates on a pivot which is supported in cantilever fashion on the tool 17. Of necessity the pivot is relatively small. The working load is carried by a relatively small area of the pivot so that both the pivot and the roll are prone to wear. When the pivots become worn the rolls will no longer be able to expand the mouth 14 of a can to the original chosen internal diameter. A further disadvantage of the prior art apparatus is that the axial extent of the expanded portion relies on the accuracy of movement of the pusher pad 15.

Figure 3:
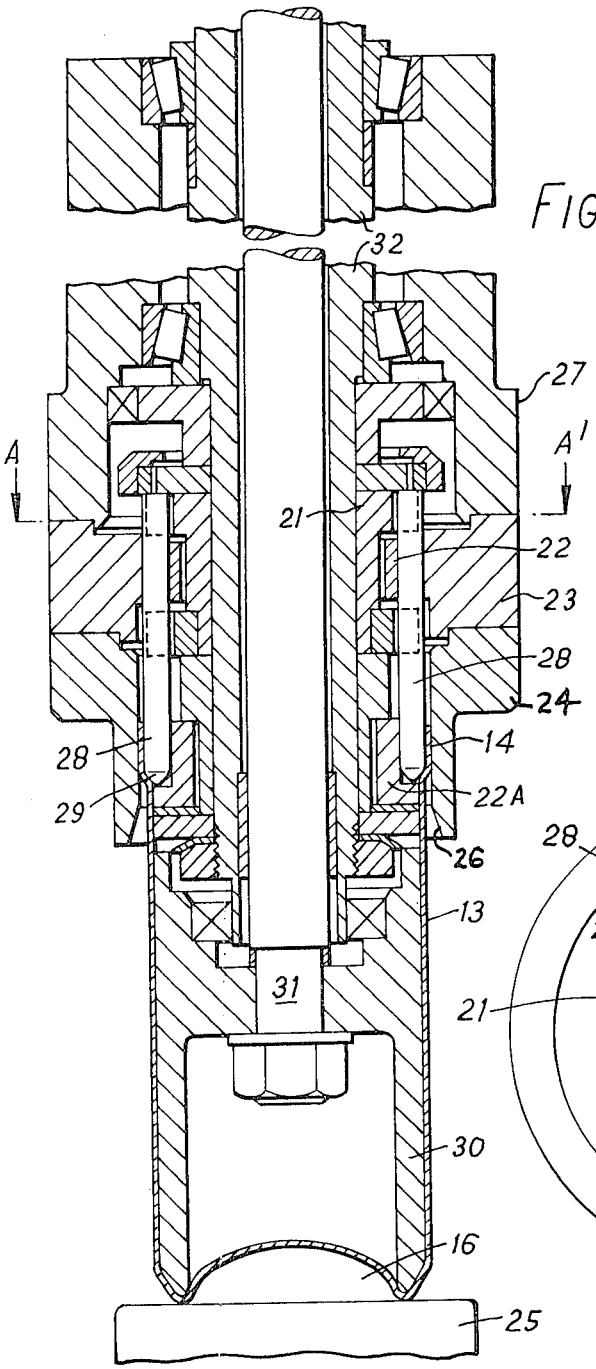
FIG. 3 is a sectioned side elevation of a preferred embodiment of the rotary expanding apparatus of the present invention.

In the preferred embodiment of the apparatus of the present invention, shown in FIG. 3, the rotary expansion tool 27 can be likened to a needle roller bearing having the lower outer part of each needle roller 28 arranged to serve in like manner to the rolls 18 in FIGS. 1 and 2. A pusher plate 25, is axially reciprocable to push a can 13 to first pass over a mandrel 30 and then engage with the rollers 28.

Figure 4:
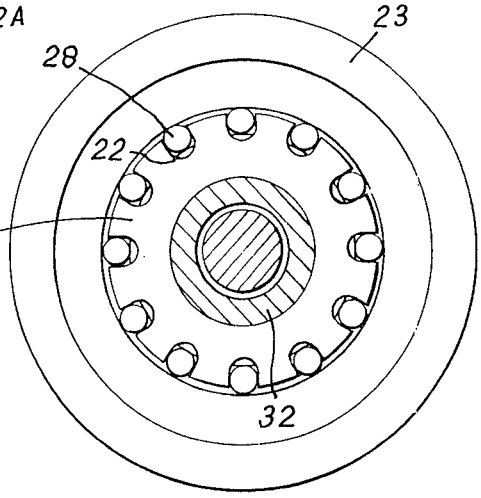
FIG. 4 is a plan view of the embodiment of FIG. 3 sectioned on a line A-A'.

In FIG. 3 the rotary expansion tool 27 comprises a plurality of needle rollers 28, held in equispaced relationship by a cage 21 around an internal supporting race 22 and within a stationary outer race 23. The cage 21 is keyed to a hollow driving shaft 32 which passes through the tool 27 to a driving means which is not shown. Rotation of the cage 21 causes the needle rollers 18 to roll upon the inside of the stationary outer race 23 while supported by the freely mounted rotating inner race 22, as may be seen in FIG. 4.

In FIG. 3 the outer stationary race 23 only engages with an upper portion of each needle 28 so that the surface of the lower half or work portion is accessible for the expanding of the mouth of a can pushed onto it. The lower end of each needle 28 has a tapered portion 29 to facilitate entry into the mouth of a can 13 at the beginning of the expanding operation. A further, freely mounted rotating inner race 22 A supports the lower portion of each needle 28.

A detachable sleeve 24 is attached to the stationary outer race 23 and extends axially downwards to surround the lower half of the needle rollers 28 and beyond to an outwardly flared portion 26. The upper cylindrical portion of the sleeve 24 which surrounds the rollers 28 serves to limit the outward expansion of the mouth of the can 13 by the rollers 28. The lower portion of the sleeve shrouds the rollers 28 for safety. The flared portion 26 serves as a guide for the mouth of the can on entering the sleeve. There is a clearance between the inside of the sleeve 24 and the rollers 28 sufficient to allow entry of the can wall, and exit of the expanded portion 14. This clearance is large enough to accommodate the deformed walls of a drawn can such as is commonly caused when the can is stripped from the press tools of a previous manufacturing operation. A typical bent over portion, such as is caused by stripper, is denoted 11 in FIG. 1.

In FIG. 3 a stationary mandrel 30 is mounted on a spindle 31 which passes coaxially through the hollow driving shaft 32 which carries the cage 21. The mandrel 30 extends axially downwards from the hollow driving shaft 32 and is of such a diameter that the can wall 13 is a sliding fit upon it. The mandrel 30 therefore serves not only as a guide to feed the can wall 13 centrally onto the rollers 28 for expansion, but also as a means to terminate the axial extent of the expanded portion 14, when the bottom 16 of the can 13 such as that shown in FIG. 1 abutts the end of the mandrel 30.

In a preferred embodiment an air mist of an emulsion of mineral oil in water is directed into the rotary expansion tool 27 to lubricate the needle rollers 28 and generally control the temperature of the tool 27.

The shape of the tapered portion 29 of the needle rollers 28 is chosen primarily to facilitate the entry of the rollers into the mouth of the can, however a variety of shapes is possible and the shape chosen in a can making operation is preferably such that after trimming within the portion which joins the expanded portion 14 to the can wall 13, the outwardly directed portion remaining on the can wall 13 will be a start flange.

Although the invention has been described in terms of apparatus in which each can is moved vertically to engage with the expanding tool, the rotary expanding tool of the invention may alternatively be mounted in known machines having means for horizontal reciprocation of the tools and a turret which carries a plurality of such tools.

In a modification of the arrangement a cage is freely rotatable and an inner race is keyed to the hollow driving shaft for rotation thereby so that the work rolls are moved to roll around within the outer race.

We claim:

1. A rotary expansion tool for radically expanding the mouth of a hollow article, said tool comprising a cage, a plurality of rollers held by the cage in circumferentially spaced relation for movement in an orbit about a longitudinal axis, and separately formed inner race and outer race, coaxial with said orbit, said inner race holding the rollers between said inner race and said outer race, each roller having a work portion projecting longitudinally beyond said outer race, drive means operatively connected to said rollers for precessing said rollers within said outer race in said orbit around said axis to effect rotation of said work portions prior to engagement thereof with an article, and support means for holding an article coaxially with said orbit with said rotating work portions progressively engaging the mouth of the article so as to expand the mouth outwardly and axially to a predetermined dimension.

2. A rotary expansion tool according to claim 1 wherein said work portion of each roller is supported by a second inner race.

3. A rotary expansion tool according to claim 2 wherein at least one of said inner races is mounted for free rotation and said drive means includes means for rotating said cage to rotate said rollers and urge each roller to roll within said outer race while supported by said freely rotating inner race.

4. A rotary tool according to claim 2 wherein both of said inner races are mounted for free rotation.

5. A rotary expansion tool according to claim 1 wherein said inner race is mounted for free rotation and said drive means includes means for rotating said cage to rotate said roller and urge each roller to roll within said outer race while supported by said freely rotating inner race.

6. A rotary expansion tool according to claim 1 wherein said drive means includes means for rotating said inner race to rotate said roller and urge each roller to roll within said outer race while supported by said inner race.

7. A rotary expansion tool according to claim 1 wherein said support means includes a mandrel extending in an axial direction concentric with said rollers and said mandrel having a diameter substantially equal to that of the mouth of article before the mouth is expanded so that the mandrel serves to guide the article on to said rotating work portions of said rollers.

8. A rotary expansion tool according to claim 7 wherein the axial length of the mandrel from said rollers to the end thereof is equal to an unexpanded height of the article.

9. A rotary expansion tool according to claim 1 together with a sleeve extending axially from the outer race to surround the working portion of each roller.

10. A rotary tool according to claim 9 wherein said second inner race transversely opposes said sleeve.

11. A rotary tool according to claim 9 wherein said second inner race transversely opposes said sleeve, and the first mentioned inner race transversely opposes said outer race.

12. A rotary tool according to claim 1 wherein said cage includes axially spaced portions, and said inner race and said outer race are in transversely opposed relation and are disposed axially between said cage portions.

13. Apparatus for expanding the mouth of a hollow article said apparatus comprising a rotary expansion tool and a holding pad reciprocable towards and away from said tool, said rotary expansion tool including a separate cage, inner race and outer race, a plurality of rolls held in equispaced relationship by said cage around said inner race with said inner race holding said rolls in rolling engagement with said outer race, and drive means operatively connected to said rolls for causing said rolls to roll within said outer race, each of said rolls having a work portion extending in an axial direction beyond said outer race for rotatably entering the mouth of an article pushed into engagement therewith by the pad to expand the mouth.

14. A method of expanding the mouth of a hollow article, said method comprising the steps of causing a plurality of rolls to orbit between an inner race and an outer race as said orbiting rolls are orbited around a longitudinal axis, bringing the mouth of a hollow article to engage with an end portion or each orbiting roll axially passing the mouth of the article over said orbiting rolls to expand the mouth of the article.

* * * * *